US008029080B2

(12) United States Patent
MacElveen

(10) Patent No.: US 8,029,080 B2
(45) Date of Patent: Oct. 4, 2011

(54) OPENING AND CLOSING SYSTEM FOR A DRAWER

(75) Inventor: Christopher MacElveen, Lake Forest Park, WA (US)

(73) Assignee: Christopher MacElveen, Lake Forest Park, WA (US)

( * ) Notice: Subject to any disclaimer, the term of this patent is extended or adjusted under 35 U.S.C. 154(b) by 743 days.

(21) Appl. No.: 12/120,143

(22) Filed: May 13, 2008

(65) Prior Publication Data

US 2009/0284113 A1 Nov. 19, 2009

(51) Int. Cl.
*A47B 95/00* (2006.01)

(52) U.S. Cl. ..... 312/333; 312/319.2; 312/334.47

(58) Field of Classification Search .... 312/319.1–319.2, 312/333, 334.44–334.47, 334.6–334.7, 334.12, 312/334.15, 334.18–334.19, 334.21, 334.33, 312/334.35, 334.36, 334.39, 334.41, 334.42; 384/21

See application file for complete search history.

(56) References Cited

U.S. PATENT DOCUMENTS

| | | | | |
|---|---|---|---|---|
| 1,391,004 | A | 9/1921 | Ohnstrand | |
| 3,954,315 | A | 5/1976 | Sanden | |
| 5,292,158 | A * | 3/1994 | Kurosaki | 292/45 |
| 7,104,691 | B2 | 9/2006 | Chi | |
| 7,448,704 | B2 * | 11/2008 | Lam et al. | 312/333 |
| 7,604,309 | B2 * | 10/2009 | Chen et al. | 312/334.46 |
| 7,753,459 | B2 * | 7/2010 | Kappler et al. | 312/333 |
| 7,874,597 | B2 * | 1/2011 | Tomita et al. | 292/137 |
| 2001/0003407 | A1 * | 6/2001 | Fraccaro | 312/333 |
| 2006/0043851 | A1 * | 3/2006 | Lee | 312/333 |
| 2008/0030111 | A1 * | 2/2008 | Liu | 312/221 |

* cited by examiner

*Primary Examiner* — Hanh V Tran
(74) *Attorney, Agent, or Firm* — Lowe Graham Jones PLLC

(57) ABSTRACT

An opening and closing system permits a drawer to be operated by pressing on a front panel of the drawer (e.g., in a hands-free manner). By way of example, the system includes a first sub-assembly coupled to the drawer and a second sub-assembly coupled to a drawer frame. A linear spring provides a tensioning force for operation of the drawer. The first sub-assembly includes a first pivot biasly coupled to the drawer, a fixed-length arm having a first end fixed to the first pivot and a second end coupled to a roller. The second sub-assembly includes first and second guide arms coupled to a second pivot, the first guide arm having an upper surface for engaging the roller when the drawer is being closed, the second guide arm having an arcuate-shaped region sized to receive at least a portion of the roller after the drawer is closed.

9 Claims, 5 Drawing Sheets

OPENING AND CLOSING SYSTEM FOR A DRAWER

FIELD OF THE INVENTION

This invention relates generally to an opening and closing system for a drawer, and more specifically to an opening and closing system for drawer positioned in a cabinet.

BACKGROUND OF THE INVENTION

Conventional drawer slide systems generally include a drawer having tracks located along the sides of the drawer. The tracks translate or glide on rollers coupled to a cabinet or other frame where the drawer may be installed. By way of example, one type of conventional drawer slide system is described in U.S. Pat. No. 3,937,531 while a cam-type drawer glide system is described in U.S. Pat. No. 1,391,004.

SUMMARY OF THE INVENTION

The present invention relates to an opening and closing system for a drawer, and more specifically to an opening and closing system for a drawer received by a drawer frame. Opening and closing of the drawer may be accomplished by pressing on the drawer to activate the system. In one embodiment, the opening and closing system permits a drawer to be operated by pressing on a front panel of the drawer (e.g., in a hands-free manner). By way of example, the system includes a first sub-assembly coupled to the drawer and a second sub-assembly coupled to a drawer frame. A linear spring provides a tensioning force for operation of the drawer. The first sub-assembly includes a first pivot biasly coupled to the drawer, a fixed-length arm having a first end fixed to the first pivot and a second end coupled to a roller. The second sub-assembly includes first and second guide arms coupled to a second pivot, the first guide arm having an upper surface for engaging the roller when the drawer is being closed, the second guide arm having an arcuate-shaped region sized to receive at least a portion of the roller after the drawer is closed.

In accordance with an aspect of the invention, a drawer system includes a drawer frame having a guide track; a drawer having a complementary guide track engageable with the guide track of the drawer frame; a linear biasing member having a first end coupled to the drawer frame and a second end coupled to the drawer; a first sub-assembly coupled to the drawer, the first sub-assembly including a first pivot biasly coupled to the drawer, a fixed-length arm having a first end fixed to the first pivot and a second end coupled to a roller; and a second sub-assembly coupled to a drawer frame, the second sub-assembly including first and second guide arms coupled to a second pivot, the first guide arm having an upper surface arranged to come into rolling contact with the roller when the drawer is being moved to a closed position, the second guide arm having an arcuate-shaped region sized to receive at least a portion of the roller when the drawer is in the closed position.

In accordance with another aspect of the invention, an opening and closing assembly for a drawer system includes a linear biasing member extending between the drawer and the drawer frame; a first sub-assembly coupled to a drawer, the first sub-assembly including a first pivot biasly coupled to the drawer, a fixed-length arm having a first end fixed to the first pivot and a second end coupled to a roller; and a second sub-assembly coupled to a drawer frame, the second sub-assembly including first and second guide arms coupled to a second pivot, the first guide arm having an upper surface that comes into rolling contact with the roller when the drawer is being moved to a closed position, the second guide arm having an arcuate-shaped region sized to receive at least a portion of the roller when the drawer is in the closed position.

In accordance with yet another aspect of the invention, a method of opening and closing a drawer includes the steps of (1) upon closing the drawer, urging a roller onto a surface of a first guide arm, the roller located at a fixed position from a first torsional biasing mechanism arranged to bias the roller in a first rotational direction such that the roller remains in contact with the surface of the first guide arm; (2) receiving the roller into an arcuate shaped retention member configured to cooperate with a second torsional biasing mechanism to maintain at least a portion of the roller in the arcuate shaped retention member; (3) upon opening the drawer, urging the roller off a lower edge of the arcuate shaped retention member; and (4) moving the drawer into an open position.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

Figure 1A:
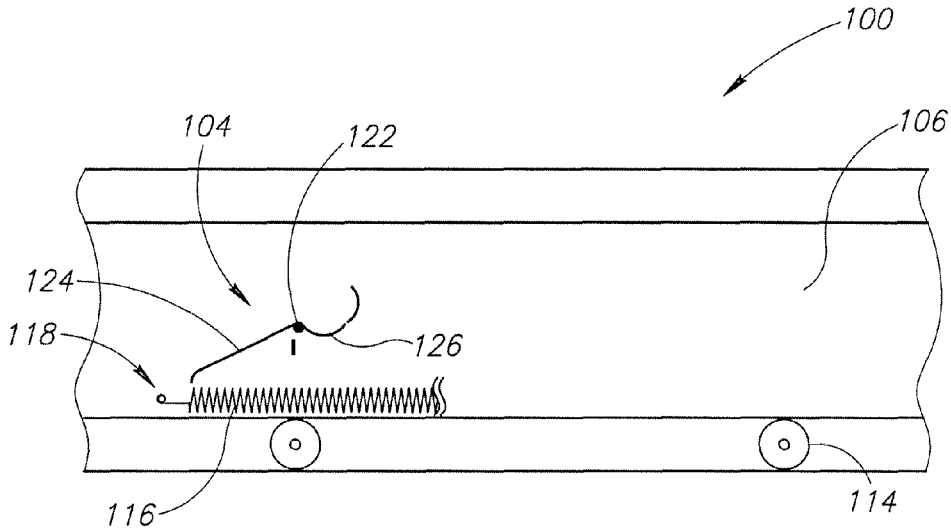
FIG. 1A is a side elevational, schematic view of a first portion of an opening and closing system for a drawer according to an embodiment of the present invention.

As will be described in further detail below, at least one embodiment of the invention includes an opening and closing system for a drawer that permits the drawer to be opened and closed by pressing on the drawer. By way of example, the opening and closing system permits a heavily weighted drawer to be easily opened and closed through action of the opening and closing system in combination with a conventional drawer track-roller assembly. By way of an additional example, the opening and closing system permits a drawer to be easily opened and closed without touching the drawer with one's hand (i.e., hands-free). In the illustrated embodiments, like components retain their same reference numerals unless the components have been substantially modified as part of an alternate embodiment in which they may then be provided with different reference numerals.

Figure 1B:
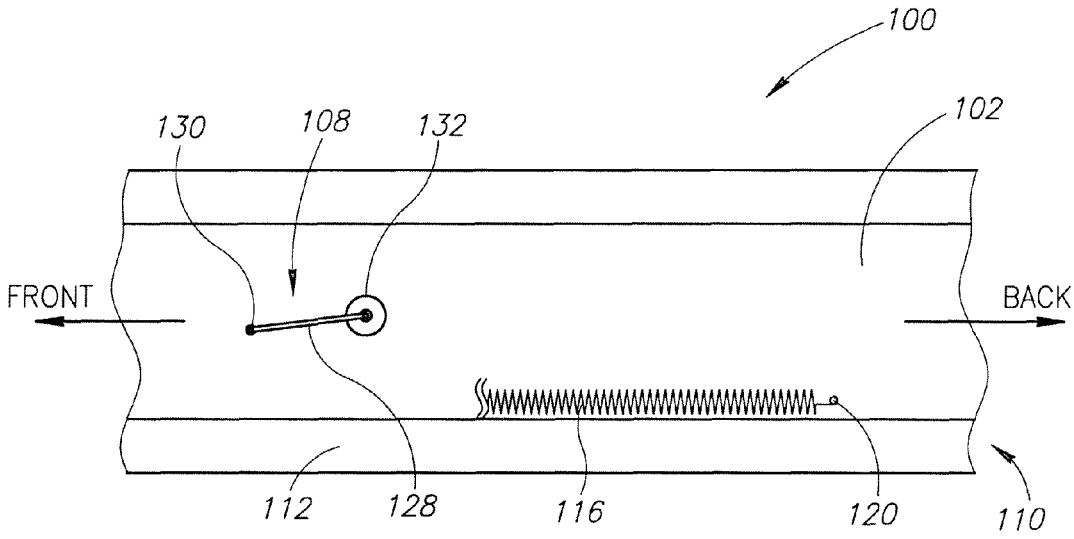
FIG. 1B is a side elevational, schematic view of a second portion of an opening and closing system for a drawer according to an embodiment of the present invention.

FIGS. 1A and 1B show an opening and closing system 100 for a drawer 102 with a first portion 104 of the system attached to a drawer frame 106 and a second portion 108 of the system 100 attached to the drawer 102, respectively. In the illustrated embodiment, the drawer 102 and the drawer frame 106 comprise a conventional drawer 102 and drawer frame 106 with a track and roller system 110 in which a track 112 coupled to the drawer 102 rides on rollers 114 coupled to the drawer frame 106. Further, the illustrated embodiment shows the drawer 102 oriented such that the front portion of the drawer 102 faces to the left and the back portion of the drawer 102 faces to the right as indicated by the arrows. For purposes of brevity, the structural aspects and operation of the conventional drawer 102 and drawer frame 106 will not be described in detail.

The opening and closing system 100 includes a biasing member 116 having a first end 118 coupled to the drawer frame 106 (FIG. 1A) and a second end 120 coupled to the drawer 102 (FIG. 1B). The biasing member 116 may take the form of a linear tension spring. The first portion 104 includes a first pivot 122 positioned and coupled to a first guide arm 124 and to a second guide arm 126. The second portion 108 includes a fixed-length arm 128 rotationally coupled to a second pivot 130. The fixed-length arm 128 is attached to a roller 132.

Figure 2:
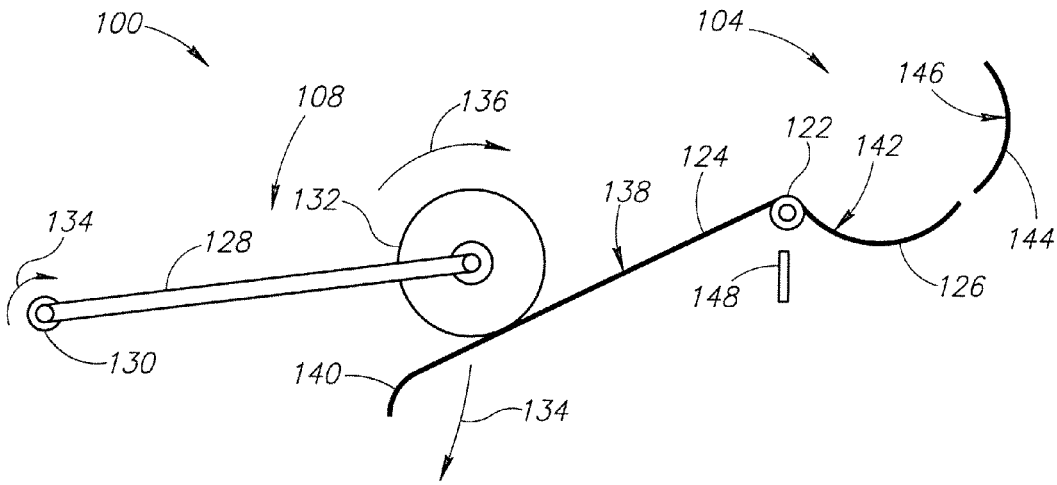
FIG. 2 is a side elevational, schematic view of the first and second portions of the opening and closing system showing the drawer being moved to a closed position.

FIG. 2 shows the opening and closing system 100 in operation in which the drawer 102 (FIG. 1B) is at least partly open and in the process of being moved to a closed position. For purposes of clarity, the drawer 102 and drawer frame 106 are not shown in FIG. 2. Beginning with the second portion 108 of the system 100, the fixed-length arm 128 is coupled to the second pivot 130, which includes a biasing mechanism configured to urge the fixed-length arm 128 in a downward direction (i.e., rotate the fixed-length arm 128 in a clockwise motion about the second pivot 130 as indicated generally by a directional arrow 134 in the illustrated embodiment). The second pivot 130 may include or take the form of a torsional spring. Further, the fixed-length arm 128 is rotationally coupled to the roller 132, which is permitted to roll in at least a first rotational direction 136. In one embodiment, the fixed-length arm 128 is coupled to a bearing pressed into a central opening of the roller 132. Further, the second pivot 130 may be configured to allow the fixed-length arm 128 to move through a predetermined range of motion. The fixed-length arm 128, second pivot 130, and the roller 132 may be attached toward a front portion of the drawer 102 with the fixed-length arm 128 extending toward a rear portion of the drawer 102.

During the initial stage of moving the drawer into the closed position, the second pivot 130 urges the roller 132 onto an upper surface 138 of the first guide arm 124. As the drawer 102 moves further toward the closed position, the roller 132 rolls onto and up the upper surface 138 of the first guide arm 124. To allow the roller 132 to adequately engage and roll onto the upper surface 138, an end portion 140 of the first guide arm 124 may be bent or curved accordingly. Preferably, the second guide arm 126 rotates along with the first guide arm 124. Alternately, the first guide arm 124 and the second guide aim 126 remain in a fixed relationship with one another during opening and closing of the drawer. The second guide arm 126 includes an arcuate or concave inner surface 142 sized to receive the roller 132 after it has rolled up the upper surface 138 and past the first pivot 122. In addition, the first portion 104 of the system 100 includes a catch or stop member 144 configured to receive the roller 132 in the event the drawer is closed too quickly and the roller 132 overshoots or over-travels the first guide arm 124. As a closing force on the drawer 102 is released, the roller 132 is caught in the second guide arm 126, which is urged against the stop member 144 to keep the second guide arm 126 from rotating any further. Depending on how quickly the drawer 102 is closed primarily determines whether the catch member 144 actually receives the roller 132. The catch member 144 may include an arcuate receiving surface 146 and be oriented such that the roller 132 will be torsionally urged into the second guide arm 126 by pivot 130.

Figure 3:
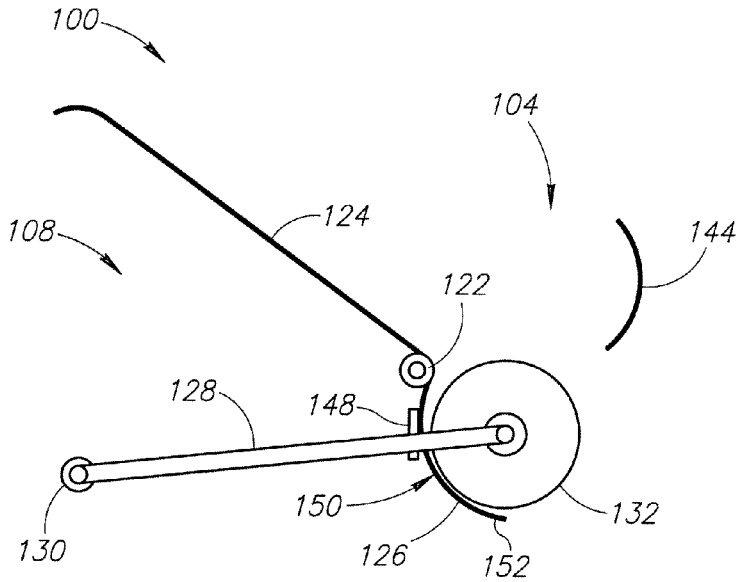
FIG. 3 is a side elevational, schematic view of the first and second portions of the opening and closing system showing the drawer in the closed position.

FIG. 3 shows the drawer 102 in the closed position in which the roller 132 is fully received into the second guide arm 126. A fixed stop device 148 may be oriented to contact a backside surface 150 of the second guide arm 126. The second guide arm 126 is held in contact with the stop device 148 by the tension provided by the linear tension spring 116 which when the drawer is closed is in full extension exerting pull on the roller arm assembly, pivot 130 fixed length arm 128 and roller 132 towards the front of the drawer. The roller 132 is held in place by the arcuate inner surface 142 (FIG. 2) of the second guide arm 126. In the illustrated embodiment showing the drawer 102 in the closed position, a rear surface (not shown) of a front drawer panel (not shown) attached to the drawer 102 may now be located proximate an exposed surface of the cabinet or drawer frame 106. Further, the biasing member 116 is at a maximum spring force when the drawer 102 is in the closed position. In one embodiment, the roller 132 is held in the arcuate inner surface 142 (FIG. 2) of the second guide arm 126 by the tension in the linear biasing member 116, which is maximally extended when the drawer is in the closed position.

Figure 4:
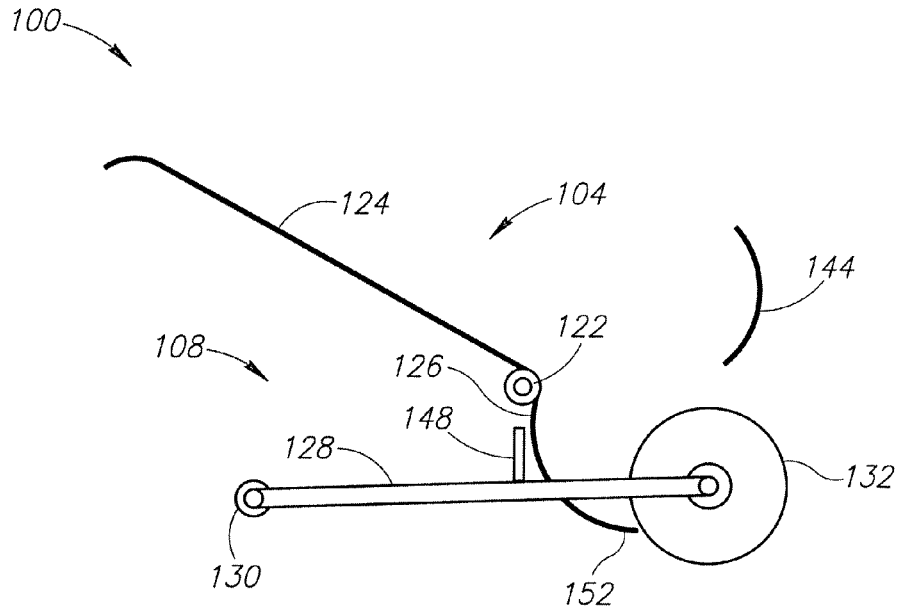
FIG. 4 is a side elevational, schematic view of the first and second portions of the opening and closing system showing the drawer being initially moved to an open position.

FIG. 4 shows an initial stage of the drawer 102 being moved to the open position. A select amount of force applied to the front drawer panel (not shown) cooperates with the second pivot 130 to urge the roller 132 off the curved end portion 152. Once the roller 132 clears the end portion 152, the first pivot 122 operates to rotate the first and second guide arms 124, 126, respectively back to the position shown in FIG. 2. In one embodiment, the torsional spring force of the second pivot 130 is significantly greater than the torsional spring force of the first pivot 122, which in turn permits the roller 132 to clear the end portion 152. By way of example, the torsional spring force of the second pivot 130 may be about four times greater than the torsional spring force of the first pivot 122.

Figure 5:
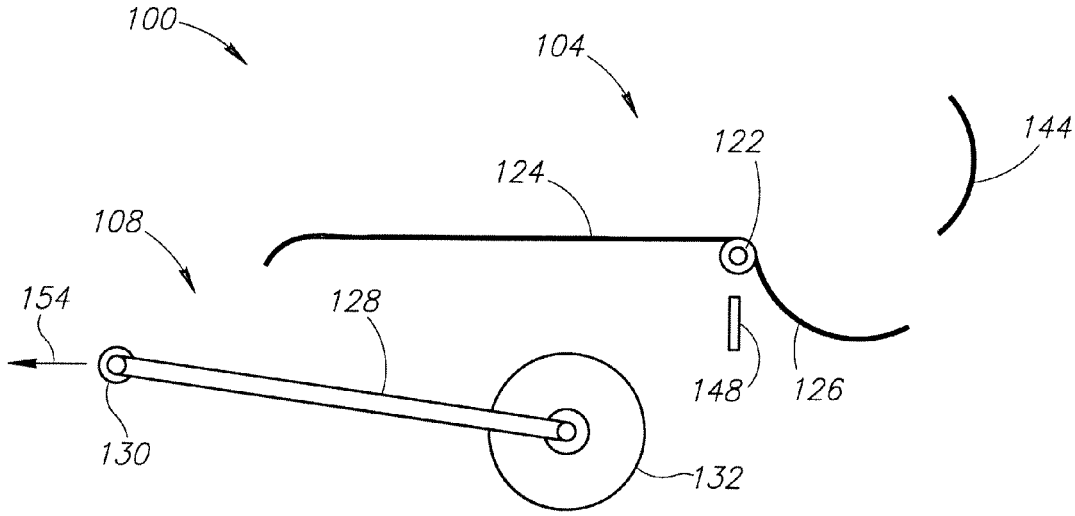
FIG. 5 is a side elevational, schematic view of the first and second portions of the opening and closing system showing the drawer being moved further toward the open position.

FIG. 5 shows the drawer moving further toward the open position as indicated by a directional arrow 154. Specifically, the roller 132 of second portion 108 has fully cleared the end portion 152 (FIG. 4) of the second guide arm 126. In addition, the first and second guide arms 124, 126 of the first portion 104 have begun to rotate about the first pivot 122.

FIGS. 6-9 show another opening and closing system 200 for a drawer with a first portion 204 of the system attached to a drawer frame or cabinet and a second portion 208 of the system 200 attached to the drawer, respectively, according to an embodiment of the present invention. Similar to the aforementioned embodiment, the second portion 208 is substantially identical to the second portion 108 described above, which includes the fixed-length arm 128 coupled to the second pivot 130 and coupled to the roller 132 and further includes the stop 144.

Figure 6:
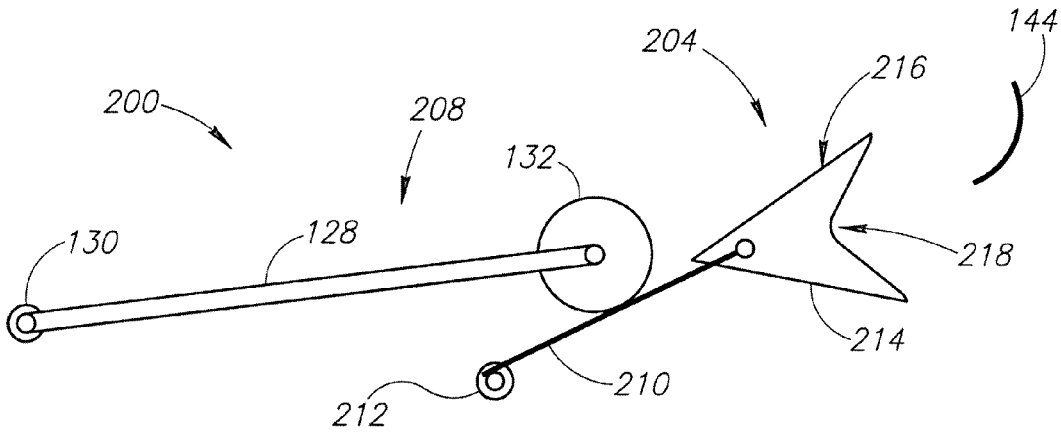
FIG. 6 a side elevational, schematic view of an opening and closing system showing the system operating to move a drawer to a closed position according to another embodiment of the present invention.
Figure 7:
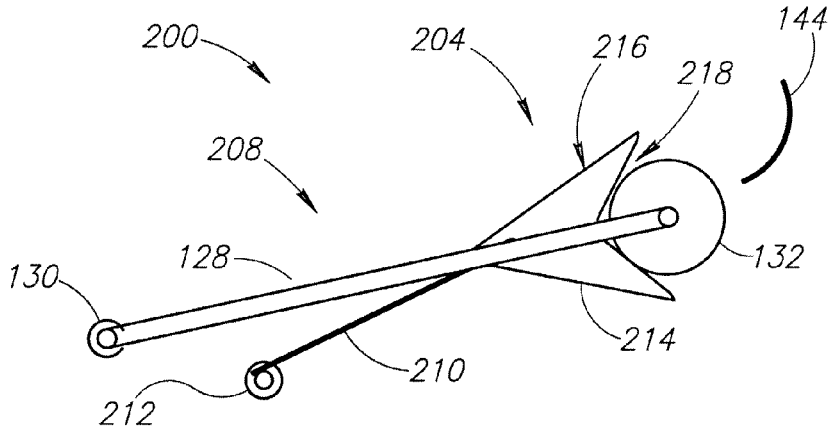
FIG. 7 a side elevational, schematic view of the opening and closing system of FIG. 6 showing the drawer in the closed position.

In the illustrated embodiment, the first portion 204 of the system 200 includes a first guide arm 210 extending between a fixed stop 212 and a cam member 214. The cam member 214 may include a rolling contact surface 216 and a roller receiving groove 218. In operation, the roller 132 is urged up the first guide arm 210 and up the rolling contact surface 216 of the cam member 214 as the drawer 202 is closed as best shown in FIG. 6. The second pivot 130, which may take the form of a torsional spring, maintains the roller 132 in contact with the first guide arm 210 and the rolling contact surface 216 of the cam member 214. After the drawer is sufficiently closed, the second pivot 130 urges the roller 132 into the roller receiving groove 218 formed in the cam member 214 as best shown in FIG. 7.

Figure 8:
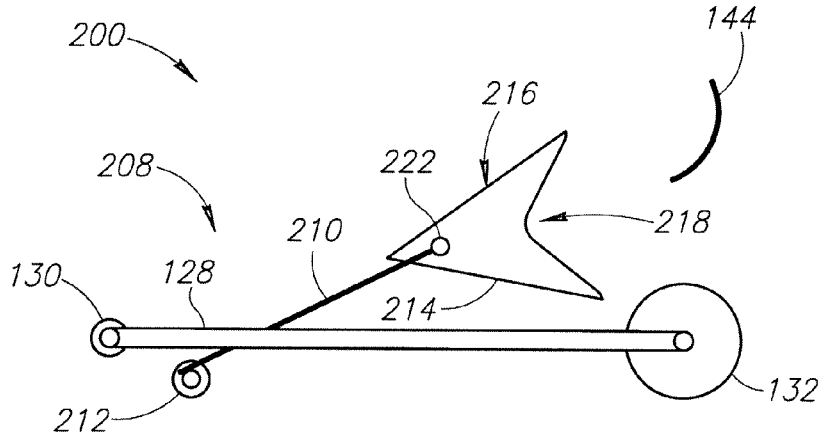
FIG. 8 a side elevational, schematic view of the opening and closing system of FIG. 6 showing the drawer being initially moved to an open position.
Figure 9:
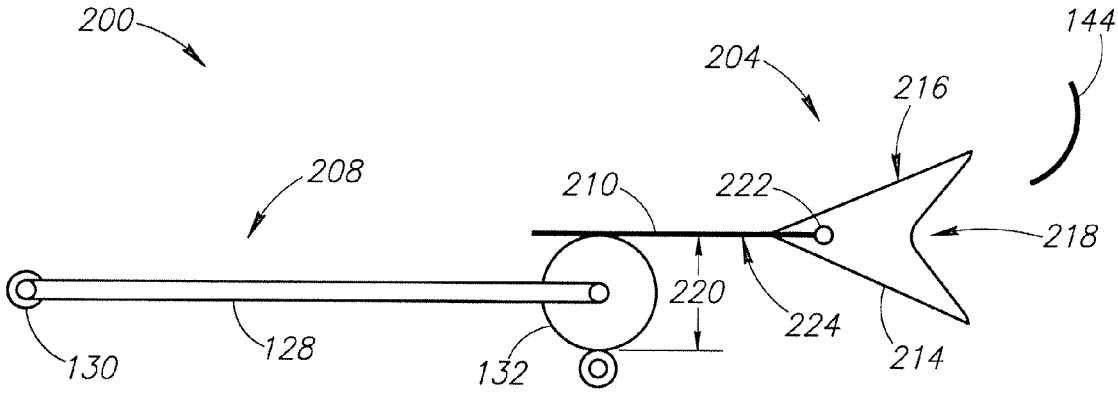
FIG. 9 a side elevational, schematic view of the opening and closing system of FIG. 6 showing the drawer being moved further toward the open position.

Upon opening the drawer, a select amount of force applied to the front face of the drawer causes the roller 132 to move out of the roller receiving groove 218, as best shown in FIGS. 8 and 9, where such movement may be aided by the second pivot 130. With the roller 132 free of the roller receiving groove 218, the drawer may begin to open, thus allowing the roller 132 to pass between the fixed stop 212 and the earn member 214. In one embodiment, a clearance distance 220 (FIG. 9) between fixed stop 212 and the cam member 214 may be equivalent to or slightly greater than a diameter of the roller 132. Further, the guide arm 210 may pivot relative to the cam member 214 by operation of a cam pivot 222 as the roller 132 moves in rolling contact with an underside surface 224 (FIG. 9) of the guide arm 210. The cam pivot 222 may take the form of a pin connection or a torsional spring. In one embodiment, the cam pivot 222 may bias the guide arm 210 against the fixed stop 212 after the roller 132 has cleared such that when the drawer is closed again the guide arm 210 will be pre-positioned to receive the roller 132.

At least one embodiment of the present invention advantageously permits a drawer to be opened and closed by pushing on the drawer with or without one's hands. In particular, the drawer may be opened without pulling on the drawer. This drawer operation advantageously permits drawers to be installed without knobs or handles, which tend to collect grime, dirt, dust and other debris in kitchen and garage areas, for example. Further, the system described herein may be used for hands free access to an under-the-counter container like a drawer, waste can, recycling container, or some other equivalent storage or container unit.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined by reference to the claims that follow.

The invention claimed is:

1. A drawer system comprising:

a drawer frame having a guide track;

a drawer having a complementary guide track engageable with the guide track of the drawer frame;

a linear biasing member having a first end coupled to the drawer frame and a second end coupled to the drawer;

a first sub-assembly coupled to the drawer, the first sub-assembly including a first pivot biasly coupled to the drawer, a fixed-length arm having a first end fixed to the first pivot and a second end coupled to a roller; and a second sub-assembly coupled to a drawer frame, the second sub-assembly including first and second guide arms coupled to a second pivot, the first guide arm having an upper surface arranged to come into rolling contact with the roller when the drawer is being moved to a closed position, the second guide arm having an arcuate-shaped region sized to receive at least a portion of the roller when the drawer is in the closed position.

2. The system of claim 1, further comprising:

a bumper mechanism coupled to the drawer frame and located to prevent the second guide arm from rotating past the bumper mechanism.

3. The system of claim 1, wherein the second pivot includes a torsional spring arranged to urge the roller along the upper surface of the first guide arm and into the arcuate-shaped region of the second guide arm.

4. The system of claim 1, further comprising:

a catch device coupled to the drawer frame and arranged to guide the roller into the arcuate-shaped region of the second guide arm when the drawer is being moved to the closed position.

5. The system of claim 1, wherein the biasing member includes a spring stiffness operable to control an opening rate of the drawer.

6. The system of claim 1, wherein the biasing member is a horizontal spring extendable to a tensioned state when the drawer is in the closed position.

7. The system of claim 1, wherein the first pivot includes a torsional spring arranged to urge the roller and the fixed-length arm in a downward direction.

8. A method of opening and closing a drawer, the method comprising:

upon closing the drawer, urging a roller onto a surface of a first guide arm, the roller located at a fixed position from a first torsional biasing mechanism arranged to bias the roller in a first rotational direction such that the roller remains in contact with the surface of the first guide arm;

receiving the roller into an arcuate shaped retention member configured to cooperate with a second torsional biasing mechanism to maintain at least a portion of the roller in the arcuate shaped retention member;

upon opening the drawer, urging the roller off a lower edge of the arcuate shaped retention member; and moving the drawer into an open position.

9. The method of claim 8, wherein urging the roller onto the surface of the first guide arm includes pushing on a front portion of the drawer.

* * * * *